US005284518A

United States Patent [19]

Kohn

[11] Patent Number: 5,284,518

[45] Date of Patent: Feb. 8, 1994

[54] RECIRCULATION VENTILATION SYSTEM FOR A SPRAY BOOTH

[75] Inventor: Michael T. Kohn, Belding, Mich.

[73] Assignee: Belco Industries, Inc., Belding, Mich.

[21] Appl. No.: 909,610

[22] Filed: Jul. 7, 1992

[51] Int. Cl.[5] ..... B05B 13/02; B05B 15/12

[52] U.S. Cl. ..... 118/324; 118/326; 118/DIG. 7

[58] Field of Search ..... 118/324, 326, DIG. 7; 427/424; 55/DIG. 46; 454/50, 51, 53, 54, 55

[56] References Cited

U.S. PATENT DOCUMENTS

| | | | |
|---|---|---|---|
| 1,502,844 | 7/1924 | Bingman | 118/326 |
| 3,744,449 | 7/1973 | Guttman et al. | 118/324 |
| 3,750,622 | 8/1973 | Repp et al. | 118/326 |
| 3,830,196 | 8/1974 | Guttman et al. | 118/326 |
| 4,048,912 | 2/1977 | Walker | 98/115.1 |
| 4,050,368 | 9/1977 | Eakes | 98/115.1 |
| 4,125,062 | 11/1978 | Eakes | 98/115.1 |
| 4,266,504 | 5/1981 | Roesner | 118/326 |
| 4,338,364 | 7/1982 | Kennon et al. | 427/424 |
| 4,351,863 | 9/1982 | Roesner | 427/424 |
| 4,567,818 | 2/1986 | Napadow | 118/326 |
| 4,664,061 | 5/1987 | Morioka et al. | 118/326 |
| 4,681,026 | 7/1987 | Sato et al. | 118/326 |

OTHER PUBLICATIONS

Chemical Engineers' Handbook, John H. Perry et al., published 1963, pp. 5-45 and 5-46.

*Primary Examiner*—Joseph W. Drodge
*Attorney, Agent, or Firm*—Waters & Morse

[57] ABSTRACT

A spray booth ventilation system is adapted for receiving long, slender workpieces suspended from an overhead monorail conveyor. The pieces are carried into and out of this booth, where the paint is applied by conventional equipment. The gases within the booth, which are a mixture of fresh air and evaporated paint solvents, is partially recirculated and re-injected into the booth at discharge orifices defining the edges of the entrance of the booth. Arrangements are provided for equalizing the flow throughout the booth in a vertical direction to avoid points of stagnation which might cause fumes from the booth to emerge from the opening, so that the velocities of the inflow can be minimized to eliminate the danger of collision of the parts as they swing in response to the gas flow, and thus cause damage to the painted surfaces.

6 Claims, 4 Drawing Sheets

RECIRCULATION VENTILATION SYSTEM FOR A SPRAY BOOTH

BACKGROUND OF THE INVENTION

Automated painting systems normally involve spray booths traversed by a conveyor. Ventilation of the booths is always a prime consideration from two different points of view. The first is the prevention of the development of an explosive gaseous mixture in the booth area resulting from evaporation of paint solvents. The second concern is the confinement of toxic fumes and paint particulate so that the areas surrounding the booth are not seriously polluted. The latter problem has been handled by inducing an inflow of air into the spray booth through the openings traversed by the conveyor as it brings the workpieces into and out of the work area. Environmental concerns require that the gases exhausted from the booth be processed to remove toxicity before being dumped into the atmosphere. This can be done with a specially constructed incinerator, which may be considered as standard available equipment.

The practical side of all this is that it costs a considerable amount to provide and operate a blower system capable of handling enough air to meet the requirements for both prevention of explosion and area pollution, and to process the exhaust gases. The lower limit for an explosive mixture is about 2,000 cubic feet of air per gallon of evaporated solvent. Fresh air must be added to the booth in sufficient quantity to exceed this amount of air by a safe margin. This can be done by removing much less exhaust than the gaseous volume required to control area pollution. The latter problem requires that air be sucked into the booth in sufficient quantity to prevent any emergence of significant quantities of the evaporated solvent. The interplay of these two concerns has given rise to the principle of recirculation of some of the gases in the booth, and to reinject them into the booth at the openings to form part of the inflow stream required to confine the gases to the interior of the booth. The corresponding reduction in exhaust volume reduces the requirements on the exhaust fan, and on the exhaust processing system—both of these being expensive items that have costs increasing with increased capacity requirements. In summary, the practical side of the design of the ventilation system is to handle as little gas volume as you can without risk.

Special problems arise when the paint systems are adapted to handle relatively long, thin workpieces suspended from an overhead monorail conveyor in closely spaced relationship. Any rapid flow of gases tends to swing these pieces enough to cause them to collide as they move into, through, and out of the booth. These small collisions are enough to mar the painted surfaces (which have not yet set and dried), and cause rejection on later inspection. These conditions are often encountered in aluminum extrusion plants, where thin strips on the order of 20 feet long may be suspended about four inches apart along a conveyor moving at the rate of 15–20 feet per minute. Sometimes the pieces are slowly rotated by the conveyor to expose both sides to the spray system; and in other installations, the pieces are sprayed in successive booths, each operating on one side of the pieces. The pieces themselves can be in a cross-section that provides an airfoil effect, accentuating the tendency to swing in the presence of a cross or parallel draft. Minimizing the velocity of this draft is obviously critical. At these lower velocities, uniformity of velocity over the full vertical height of the opening is important to avoid areas where there may be inadequate inflow, or points of concentration of explosive mixture.

SUMMARY OF THE INVENTION

The present invention provides a recirculating ventilation system for a paint spray booth particularly adapted to handling long, thin pieces suspended from an elevated monorail conveyor. The entrance to the booth is confined to a minimum width required for the effective operation of the conveyor, and recirculated gases are injected into the booth through long vertical slots immediately at the entrance to the booth, and directed inward at a velocity just sufficient to establish the necessary directions of gas flow. The injected gases are provided along the elongated slot at equalized velocity, and establish the necessary even flow over the full height of the unit. The inward direction of this flow has the added effect, even though the velocity is low, of adding some aspirated inflow of fresh air along with the recirculated gases, with the inflow also being induced by the slight reduction in pressure caused by the removal of fractional quantities of exhaust gases from the interior of the booth.

DESCRIPTION OF THE PREFERRED EMBODIMENT

Figure 1:
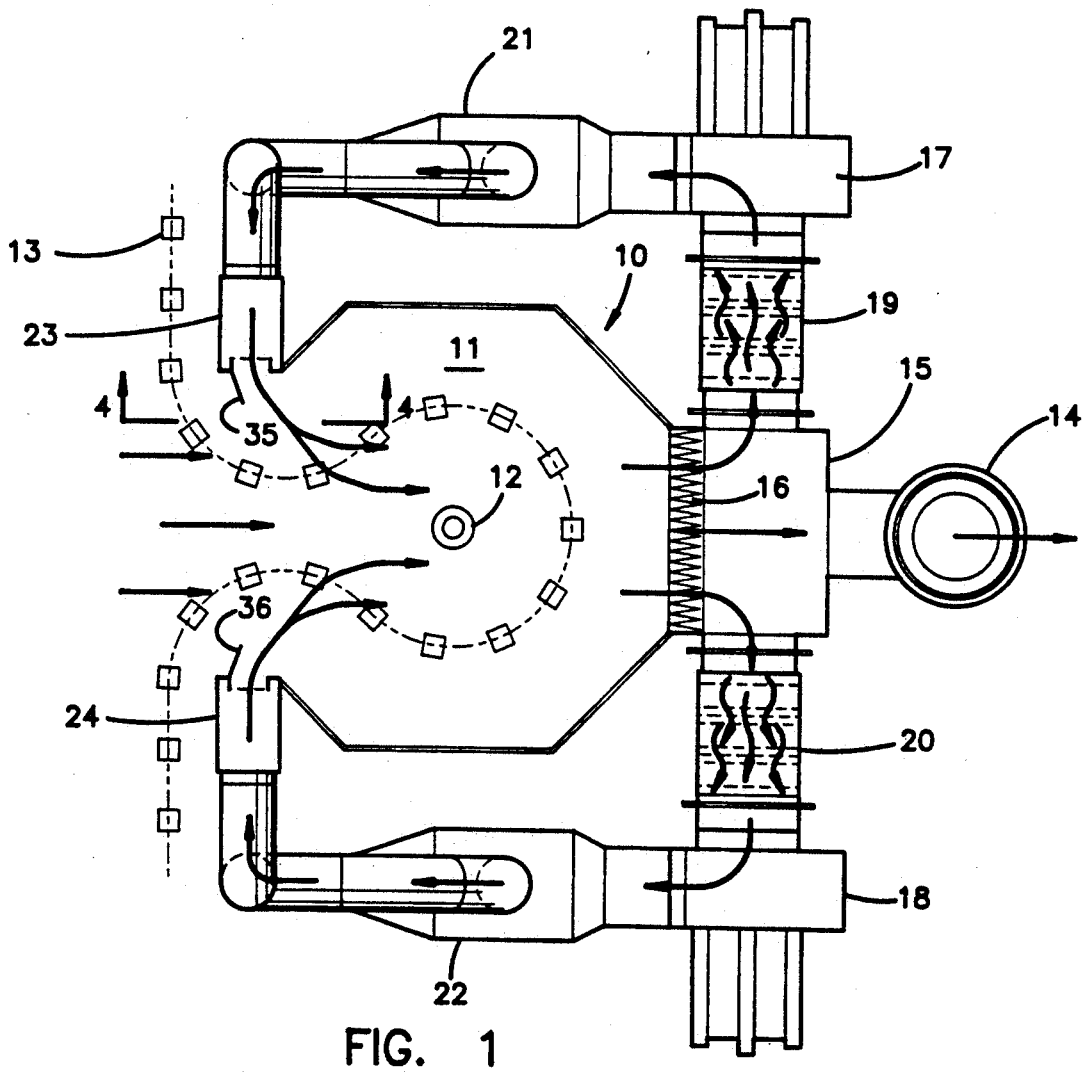
FIG. 1 is a schematic illustration of a top view of a typical spray booth meeting selected requirements for the quantity of paint to be applied. The details of this structure can be expected to vary with changes in these requirements.
Figure 3:
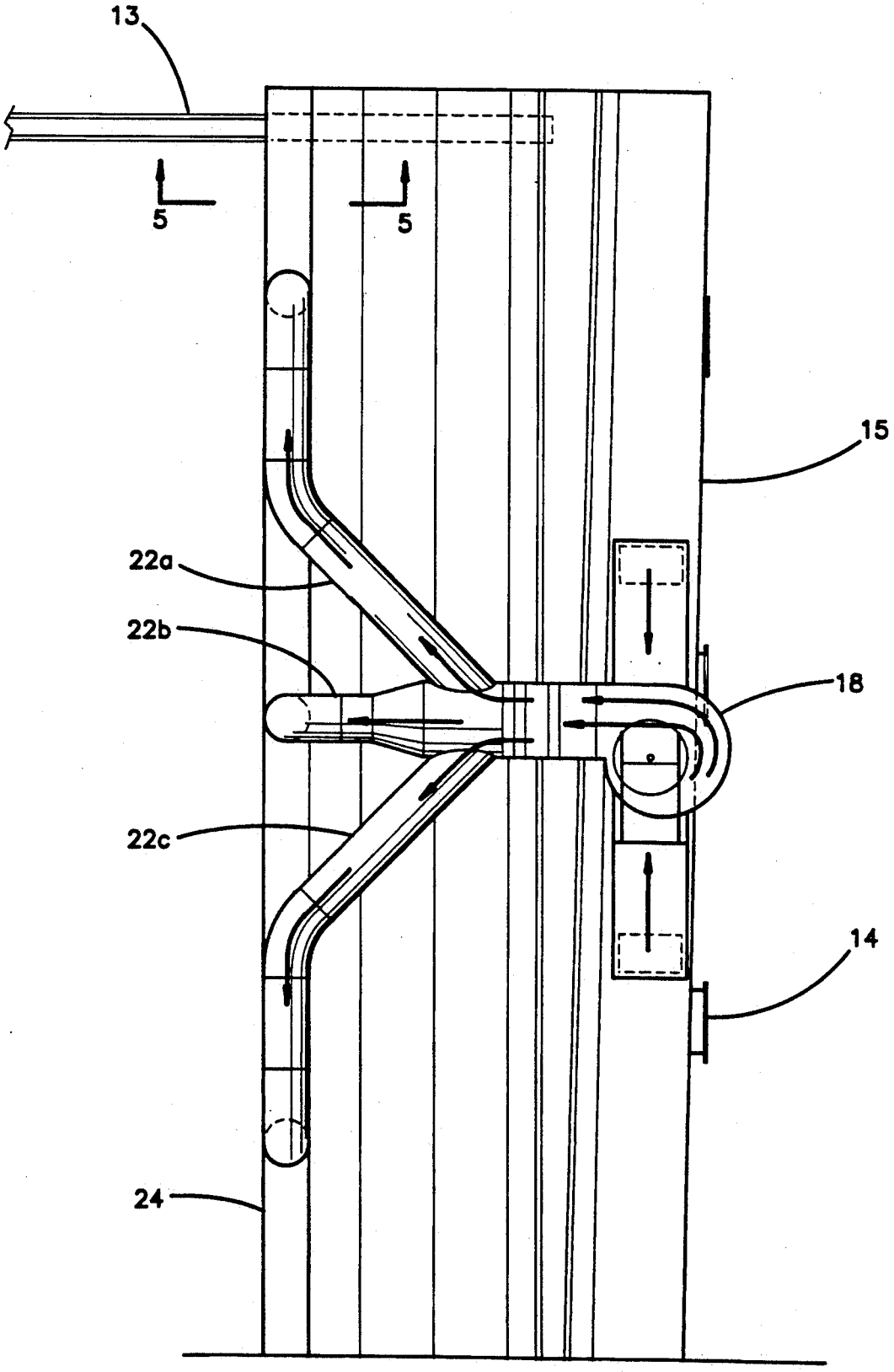
FIG. 3 is a schematic side elevation of the FIG. 1 installation.

Referring to FIG. 1, the booth structure generally indicated at 10 defines an enclosure 11 in which paint is supplied by a conventional application system indicated at 12. An elevated monorail conveyor 13 enters and leaves the booth through the opening at the left side of the view shown in FIG. 1. The loop configuration of the conveyor path within the booth has given rise to the term "omega", due to the general similarity of this configuration to the Greek letter. An exhaust fan (not shown) at a selected convenient point along the duct 14 establishes a reduced pressure in the plenum 15 to induce a outflow of the gases in the interior space 11 through the filter 16 and into the plenum, although only a portion of this gas will actually move out through the exhaust duct 14. The recirculating fans 17 and 18 are ducted to the plenum 15, and withdraw a selected fraction of its contents for delivery via the return air filter boxes 19 and 20 to the side ducting 21 and 22 communicating with the discharge orifice plenums 23 and 24. The side ducting is branched on both sides as shown in FIG. 3 at **22*a*, 22*b*, and 22*c*, so that the output of the recirculation fans is delivered at vertically spaced points along the plenums 23 and 24**.

Figure 4:
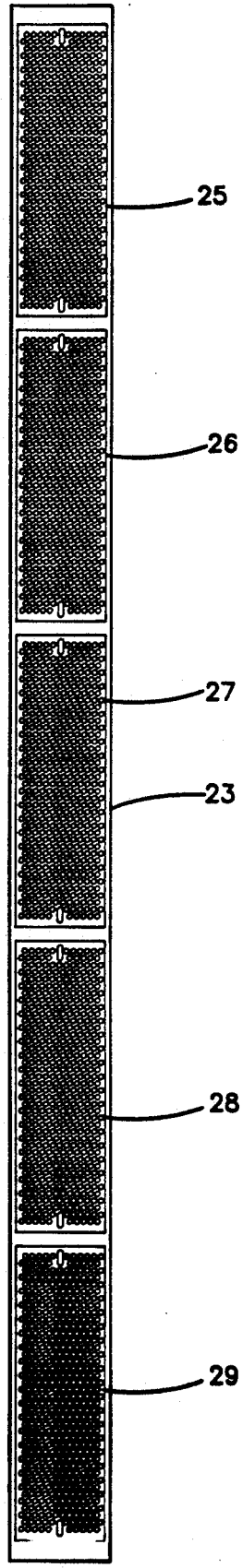
FIG. 4 is an elevation on an enlarged scale of the outlet orifice at one side of the booth entrance, taken on the plane 4—4 of FIG. 1.
Figure 5:
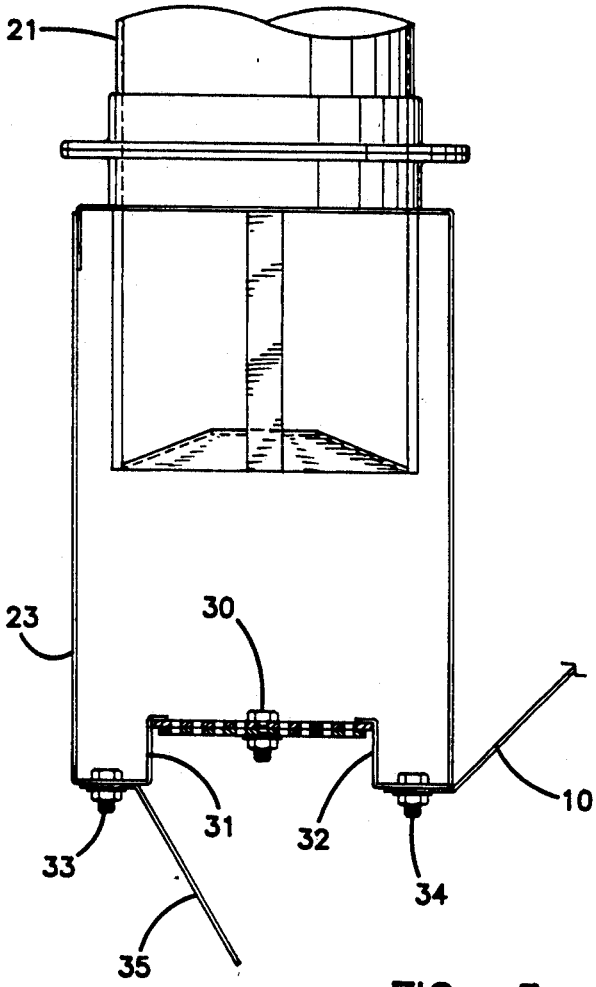
FIG. 5 is a section on an enlarged scale on the horizontal plane 5—5 of FIG. 3, showing the cross section of the injection duct.

The construction of the discharge ducts at the entrance to the booth is best shown in FIGS. 4 and 5. The discharge openings of these ducts is defined by the sets of overlapped perforated plates identified at 25–29. Each of these sets of plates is a pair with similarly arranged perforations that are laterally adjustable with respect to each other to provide a selected degree of mutual occlusion. After the selected degree of resistance to flow has been thus selected, it is locked by tightening the bolts 30. These plates are supported by the bracket strips 31 and 32 bolted to the discharge ducts and to the booth structure as shown at 33 and 34. Deflector plates as shown at 35 and 36 are incorporated to direct the flow inwardly into the opening of the booth. The combination of the overlapped perforated plates, each pair being individually adjustable, together with the branched side ducting that feeds the discharge plenums, makes it possible to vertically equalize the flow into the booth openings so that a minimum velocity is obtainable without points of complete stagnation, or of excess speed which would further induce a swinging motion of the articles suspended from the conveyor 13.

Figure 2:
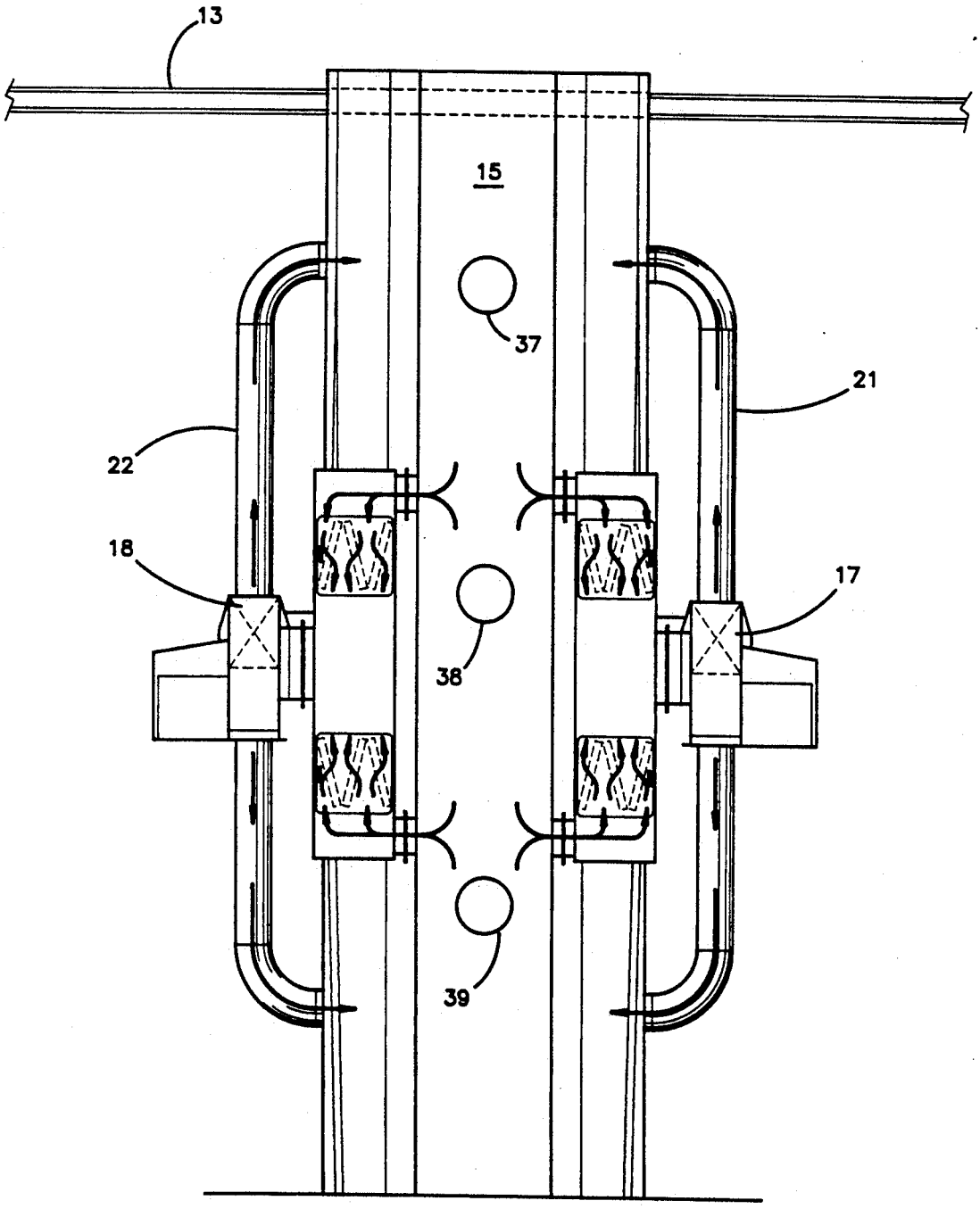
FIG. 2 is a rear schematic elevation of the installation shown in FIG. 1.

Preferably, the exhaust is withdrawn from the plenum 15 at vertically spaced points also, as indicated at 37—39 in FIG. 2. In this figure, the exhaust duct 14 is removed for clarity. Orifice plates and/or dampers (not shown) at selected positions in the ducting are adapted to establish the selected degree of recirculation of the contents of the plenum 15, as well as the vertical equalization of the flow. As a general rule, approximately two-thirds of the content of the plenum 15 is recirculated without risk of approaching the lower explosion level within the booth. The inflow into the booth should be maintained in the general neighborhood of 70 feet per minute for safeguarding the area surrounding the booth from the emergence of toxic fumes. In the installation illustrated in the drawings, the height of the structure is approximately 26 feet, with the recirculation discharge slots defined by the perforated plates being approximately six inches wide, and the jet velocity from them completely adjustable. As noted in FIG. 1, this velocity, influenced by the deflector plates 35 and 36, is directed primarily transversely to the path of the parts suspended from the conveyor 13. There is thus a minimum tendency for the parts to swing in a direction parallel to their path of movement, which would tend to cause them to collide with each other, and damage the painted surfaces. The danger of explosion within the booth will normally be monitored by a standard probe (not shown) which detects the gas conditions with respect to the lower explosion level; and activation of this probe will cause the recirculating fans to shut down. All exhaust will then be directed outside the building to the atmosphere.

An example of the specifications and calculations associated with a typical installation are as follows:

Assume Solvents Evaporate As Follows:

50% in booths
25% in flash-off area
25% in cure oven

Booth Exhaust Requirements:

| | |
|---|---|
| Mineral Spirits: | 4.15 gal./hr. × 2830 cu. ft./gal./60 min./hr. = 196 cfm |
| Butyl Alcohol: | 3.73 gal./hr. × 2410 cu. ft./gal./60 min./hr. = 150 cfm |
| Xylol: | 6.43 gal/hr. × 2670 cu. ft./gal./60 min./hr. = 286 cfm |
| Cellosolve Acetate: | 2.27 gal./hr. × 1320 cu. ft./gal./60 min./hr. = 50 cfm |

TOTAL = 682 cfm

Assume 50% evaporation in booth: 682 cfm × .50 = 341
Safety factor × 4 @ 25% L.E.L. = 1364 cfm
Fresh air required to render barely explosive = 1364 cfm
Use 1500 cfm fresh air to booth.

Booth Opening Dimensions:

26'-0" high × 4' 7" wide = 119.2 sq. ft. area × 75.0 ft./min. face vel. = 8940 cfm entering booth
Use 9000 cfm for main fan.
9000 cfm − 1500 cfm fresh air = 7400 cfm recirculated with two recirculate fans; 3750 cfm per fan System Specifications and Calculations:

| | |
|---|---|
| Product painted: | 21'-0" lg. vertically hung aluminum extrusions |
| Conveyor System: | 16 f.p.m. design, 6–24 f.p.m. variable |
| Process Rate: (estimated) | 36,480 sq. ft./hr. |
| Paint Application: | Two opposing prime coat booths; Two opposing top coat booths with 6.5 min. flash-off between each pair of booths. |
| Paint Usage: | 38.4 gal./hr. prime coat<br>38.4 gal./hr. top coat<br>76.8 gal./hr. total |
| Volatile Portion: | 75% wt. |
| Thinner Total: | 76.8 gal./hr. paint × 75.0% volatile thinner/gal. = 57.6 gal./hr. volatile thinner × 8.2 lbs./gal. average weight of thinner = 472.32 lbs. thinner/hour |
| Thinner Total/Booth: | 118.1 lbs. thinner/hour |

Solvent Composition:

| | |
|---|---|
| Mineral spirits - 23.5% wt. | |
| *2830 cu. ft.: | 118.1 lbs./hr.<br>4.15 gal./hr.<br>per booth |
| Butyl alcohol - 21.2% wt. | |
| *2410 cu. ft.: | 118.1 lbs./hr.<br>3.73 gal./hr.<br>per booth |
| Xylol - 39.7% wt. | |
| *2670 cu. ft.: | 118.1 lbs./hr.<br>6.43 gal./hr.<br>per booth |
| Cellosolve acetate - 15.6% wt. | |
| *1320 cu. ft.: | 118.6 lbs./hr.<br>2.27 gal./hr.<br>per booth |

*Approximate cu. ft. of air rendered barely explosive per gallon of solvent. Reference N.F.P.A. No. 86 Table 5-2.

I claim:

1. In combination with a spray booth installation including a vertically elongated housing defining a space having at least one relatively narrow opening extending over substantially the full height of said housing, said installation also including conveyor means adapted to bring suspended and closely spaced elongated workpieces along a path through said opening adjacent the top thereof while allowing swinging of the workpieces in the presence of gas flow, said installation further including blower and duct means adapted to establish a reduced pressure in said space, and to exhaust a portion of the gaseous contents of said space and to recirculate the remaining portion thereof:

means forming a pressurized outlet duct communicating with said blower and duct means, and disposed along at least one side of said narrow opening, and adapted to project recirculated gases into said space at said at least one opening at a vertically equalized velocity sufficiently low to prevent said suspended workpieces from swinging into collision with each other adjacent said at least one opening.

2. A ventilation system as defined in claim 1, additionally including means adapted to direct said recirculated gases into said space at said at least one opening along a path transverse to the path of said workpieces established by said conveyor means.

3. A ventilation system as defined in claim 1, wherein said velocity induces a total inflow below 100 feet per minute.

4. A ventilation system as defined in claim 1 wherein said housing has a single opening and said conveyor means is adapted to bring workpieces into and out of said space through said single opening.

5. In combination with a spray booth installation including a vertically elongated housing defining a space having at least one relatively narrow opening extending over substantially the full height of said housing, said installation also including conveyor means adapted to bring suspended and closely spaced elongated workpieces along a path through said opening adjacent the top thereof, said installation further including blower and duct means adapted to establish a reduced pressure in said space, and to exhaust a portion of the gaseous contents of said space and to recirculate the remaining portion thereof:

means forming a pressurized outlet duct communicating with said blower and duct means, and disposed along at least one side of said narrow opening, and adapted to project recirculated gases into said space at said at least one opening at a vertically equalized velocity sufficiently low to prevent said suspended workpieces from swinging into collision with each other adjacent said at least one opening; and means adapted to direct said recirculated gases into said at least one opening along a path transverse to the path of said workpieces established by said conveyor means, said means adapted to direct said recirculated gases including a deflector panel disposed along said one side of said at least one opening.

6. In combination with a spray booth installation including a vertically elongated housing defining a space having at least one relatively narrow opening extending over substantially the full height of said housing, said installation also including conveyor means adapted to bring suspended and closely spaced elongated workpieces along a path through said opening adjacent the top thereof, said installation further including blower and duct means adapted to establish a reduced pressure in said space, and to exhaust a portion of the gaseous contents of said space and to recirculate the remaining portion thereof:

means forming a pressurized outlet duct communicating with said blower and duct means, and disposed along opposite sides of said narrow opening, and adapted to project recirculated gases into said space at said at least one opening at a vertically equalized velocity sufficiently low to prevent said suspended workpieces from swinging into collision with each other adjacent said at least one opening.

* * * * *